US006751876B2

(12) United States Patent
Herold

(10) Patent No.: US 6,751,876 B2
(45) Date of Patent: Jun. 22, 2004

(54) MANUAL BELT SKIVER

(75) Inventor: Wolfgang Herold, Offenbach/Main (DE)

(73) Assignee: MATO Maschinen-und Metallwarenfabrik Curt Matthaei GmbH & Co. KG, Offenbach (DE)

( * ) Notice: Subject to any disclaimer, the term of this patent is extended or adjusted under 35 U.S.C. 154(b) by 0 days.

(21) Appl. No.: 10/104,614

(22) Filed: Mar. 22, 2002

(65) Prior Publication Data

US 2002/0157263 A1 Oct. 31, 2002

(30) Foreign Application Priority Data

Mar. 23, 2001 (EP) ..... 01107311

(51) Int. Cl.[7] ..... B26D 3/06; B26D 3/28
(52) U.S. Cl. ..... 30/486; 30/484; 30/493
(58) Field of Search ..... 30/293, 478, 167, 30/168, 169, 484, 486, 280, 294, 493

(56) References Cited

U.S. PATENT DOCUMENTS 2,757,452 A * 8/1956 Barnes ..... 30/168
3,176,396 A * 4/1965 Straka ..... 30/168
3,866,456 A * 2/1975 Shepard et al. ..... 30/168
3,929,555 A 12/1975 Sanders
4,064,775 A 12/1977 Larson
4,315,450 A 2/1982 Pray
4,656,910 A * 4/1987 Peterson ..... 83/875
5,771,587 A 6/1998 Herold

FOREIGN PATENT DOCUMENTS

| | | |
|---|---|---|
| DE | 1112279 | 3/1962 |
| DE | 8702754 | 5/1987 |
| EP | 0773089 A1 | 5/1997 |

* cited by examiner

*Primary Examiner*—Hwei-Siu Payer
(74) *Attorney, Agent, or Firm*—Price, Heneveld, Cooper, DeWitt & Litton, LLP

(57) ABSTRACT

A manual skiver for conveyor belts and the like includes a base with a flat bearing surface for engaging an associated belt face, and a blade receiving opening through the bearing surface. A handle is connected with the base to facilitate drawing the skiver across the belt face. A thin cutting blade is mounted in the base at a predetermined angle, and includes a U-shaped cutting edge defined by a flat central area and upstanding side areas at opposite sides of the central area. The U-shaped cutting edge extends through the blade opening, and is positioned a predetermined distance below the bearing surface to cut a groove in the belt face having a uniform depth.

26 Claims, 6 Drawing Sheets

SECTION C-C

SECTION A-A

MANUAL BELT SKIVER

BACKGROUND OF THE INVENTION

The present invention relates to skivers, and in particular to a manual belt skiver for removal of a portion of the top layer from a conveyor belt or the like.

Manual belt skivers are generally known in the prior art, and serve to remove the top layer or a portion of the top layer at the end of a conveyor belt. In this context, it is common to secure the belt against slippage in a support apparatus, and to then undertake processing with the skiver, whereby the skiver is pulled manually across the belt. In general, the construction of the belt skiver resembles that of a manual carpenter's plane. The planar bearing surface of the belt skiver thus lies upon the conveyor belt, whereby the slanted knife that projects beyond the bearing surface cuts away strips from the top layer, such that U-shaped or wave-shaped depressions in the conveyor belt are formed. A large number of grooves can be created in the conveyor belt by repeatedly drawing the belt skiver across the entire width or breadth of the conveyor belt, thus removing the top layer or a portion of the top layer from the end of the conveyor belt. Use of the belt skiver requires a high degree of skill and physical strength, and does not ensure that the free, skived surface is absolutely even, or that the residual wall thickness of the belt is absolutely uniform at all points.

A manual belt skiver of the above-named type is disclosed in DE-PS 11 12 279. There the knife is constructed as a stable, hollow molding cutter, the cutting edge of which lies in a plane perpendicular to the plane of symmetry of the knife's cross section, which plane, along with the outer side of the knife, encloses an acute angle, whereby two further cutting edges are provided on the exterior of the cutter head, which cutting edges deviate away from the back of the knife and which likewise lie in a plane perpendicular to the plane of symmetry of the knife's cross section, but form a rearwardly opening acute angle with the back of the knife. A belt skiver such as this only allows grooves to be created in the top layer of the conveyor belt. The construction of the knife as a hollow molding cutter is such that only a small portion of the top layer can be removed in each cutting step during manual use of the belt skiver.

EP 0773 089 A1 discloses a manual belt skiver suitable for compressive use. In any case, its base is not moved across the conveyor belt in order to remove the top layer or the portion of the top layer from the conveyor belt, but rather along its end face. A knife in the form of a thin blade, the end of which curves upward, is held in the base and projects laterally from it. In addition, a hold down mechanism is mounted in the base which lies upon the top layer of the conveyor belt and precedes the blade during the cutting process.

An apparatus for the removal of the top layer or a portion of the top layer from a conveyor belt is disclosed in DE GM 8702 754. It is not a matter of a hand tool in this case, but rather of a mechanical apparatus with which the potential exists to introduce longitudinal grooves in a previously vulcanized conveyor belt. Here it is to be ensured that a groove of an exactly defined depth, width and contour is created in the belt's top layer. The conveyor belt is moved relative to the stationary cutting apparatus so that a belt strip of unlimited length can be processed. These devices include a stationary holder for a blade. The blade is U-shaped in form, whereby the free ends of both of the blade's legs are mounted in the holder.

SUMMARY OF THE INVENTION

One object of the present invention is an improved manual belt skiver of the above-named type configured so that a relatively large portion of the top layer of a belt or a portion of the top layer of a belt can be removed with minimal expenditure of energy, whereby it is ensured that the cutting forces are optimally transferred from the belt skiver into the conveyor belt via the blade.

In one embodiment of the present invention, the knife is constructed as a thin blade with a U-shaped cutting edge, whereby the blade has a central area with its cutting edge section arranged parallel to the bearing surface of the base and oriented perpendicular to the direction of motion of the belt skiver, as well as two lateral or side areas with cutting edge sections emanating from the cutting edge section of the central area and angled into the opening of the base.

One operating principle of the belt skiver according to the present invention is that its base is moved across the top layer of the conveyor belt, in combination with the specific construction of the knife as a thin blade with bilateral curved cutting edge sections at each end. Motion of the belt skiver with its bearing surface above the conveyor belt ensures that the forces introduced into the belt skiver via the handle are directly transmitted to the blade, so that no tilting moments (as noted for belt skiver contact using another functional type in which the base is guided alongside the conveyor belt) are introduced into the belt skiver. As a consequence, the belt skiver according to the present invention also needs no hold down mechanism. Based on the type of belt skiver in which the inclined knife traverses an opening in the base, and on the particular construction of the blade, it is possible to remove a top layer from the conveyor belt with each stroke of the belt skiver, the cross section of which, as limited by the bearing surface of the base, corresponds to the cross-sectional surface of the blade.

It is considered particularly advantageous if the belt skiver is moved across the conveyor belt under compression. In this regard, the central area of the blade should be arranged at an angle to the bearing surface of the base in substantial correspondence to that angle at which the compressive force for using the belt skiver is introduced into the handle. It is expedient that this angle correspond to 5 degrees to 15 degrees, preferably 7.5 degrees to 12.5 degrees, and in particular 10 degrees.

According to a particular embodiment of the invention, it is provided that the blade be constructed symmetrically. Independent thereto, the cutting edge section for each lateral area of the blade is to be arranged at an angle of 90 degrees to 120 degrees, preferably 100 degrees to 110 degrees, relative to the cutting edge section of the central area of the blade.

Particularly good cutting results can be achieved if the blade itself is constructed so as to conically widen, beginning at the cutting edge. In this context, it is expedient that the angle of the cutting flanks adjacent to the cutting edge of the blade correspond to 15 degrees to 25 degrees, preferably 17.5 degrees to 22.5 degrees, and in particular 20 degrees. In particular, the cutting flank of the blade directed away from the base is oriented parallel to the bearing surface of the base.

If the top layer of the belt or a portion of the top layer of the belt is to be removed at a distance from the end face of the conveyor belt, it is considered advantageous for the belt skiver to include a guide apparatus that serves to provide lateral contact with the end face of the conveyor belt. The guide apparatus is preferably constructed as a bar connected to the base. It should be adjustable relative to the base.

These and other advantages of the invention will be further understood and appreciated by those skilled in the art by reference to the following written specification, claims and appended drawings.

BRIEF DESCRIPTION OF THE DRAWINGS

The invention is represented in the figures on the basis of a preferred embodiment, without being limited to it. Shown are.

DETAILED DESCRIPTION OF THE PREFERRED EMBODIMENTS

Figure 1:
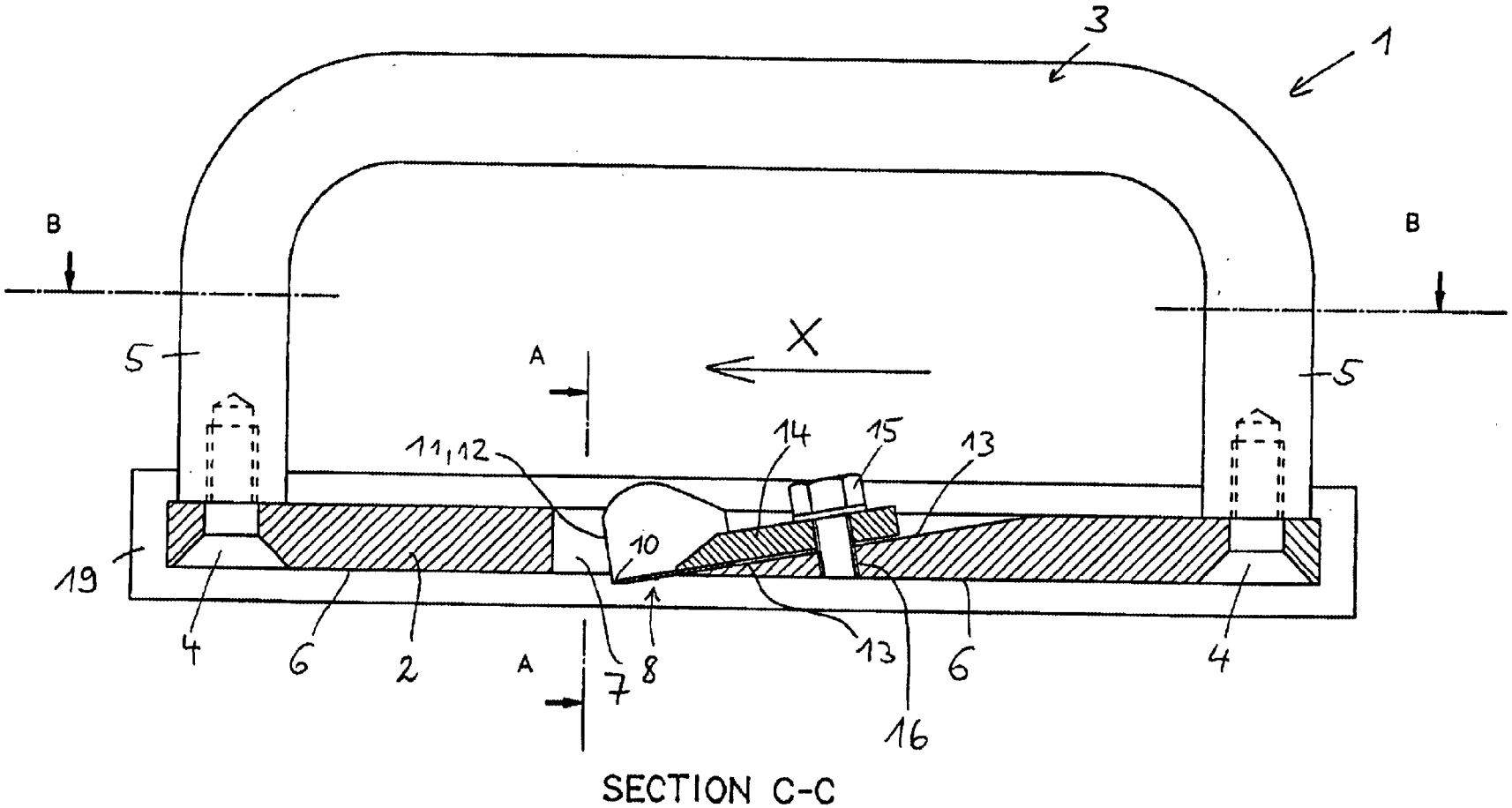
FIG. 1 is a section through the belt skiver corresponding to line C—C of FIG. 3.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The illustrated manual belt skiver 1 consists of a plate-shaped, elongated base 2 in the style of a bar or rectangular parallelepiped, to which the terminal sections of a U-shaped handle 3 are connected. Screws 4 traverse the base 2 for this purpose and are threaded into the legs 5 of the handle 3. The base 2 has a flat planar bearing surface 6 on the side facing away from the handle 3. Near the midpoint of its length, the base 2 is provided with a vertically extending opening 7 which is traversed by a knife that is constructed as a thin blade 8. In this context, "thin" is understood to mean a thickness as realized in carpet knifes, for example.

Figure 5:
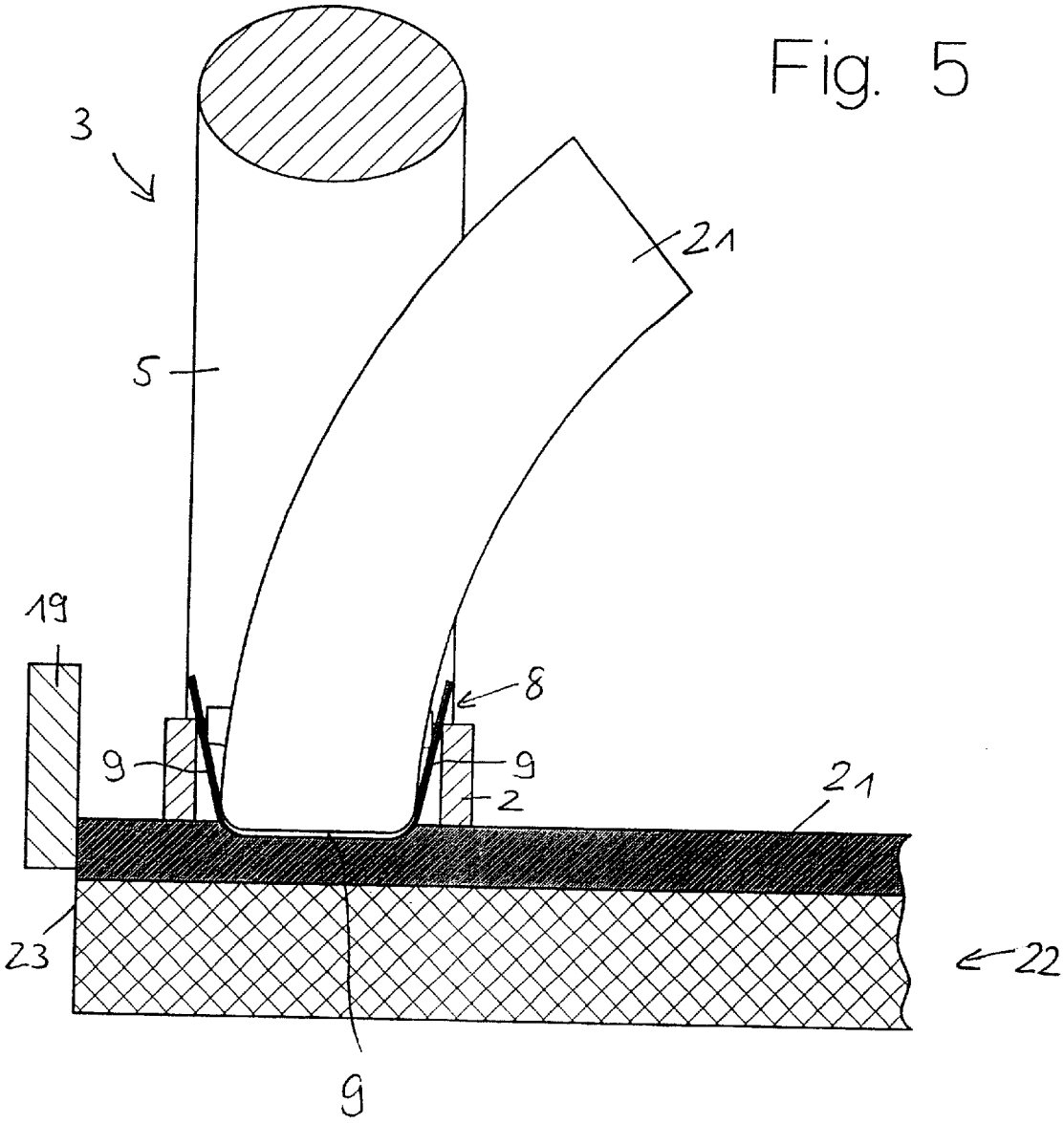
FIG. 5 illustrates the cutting process, clarified on the basis of a sectional representation as per FIG. 2.

The blade 8 has a generally U-shaped cutting edge 9 (FIG. 5). In the illustrated example, cutting edge 9 has a central region, with a flat central section or area 10 arranged parallel to the bearing surface 6 of the base 2, and oriented perpendicular to the direction of motion X of the belt skiver 1. The illustrated cutting edge 9 also has two lateral regions, with flat side sections or areas 11, 12 emanating from the central cutting edge section 10 of the central region, and angled into the opening 7 of the base 2. In the preferred embodiment, the side cutting edge sections 11 and 12 of each respective lateral area of the blade 8 are arranged at an angle of approximately 105 degrees relative to the central cutting edge section 10 of the central region of the blade 8.

Figure 2:
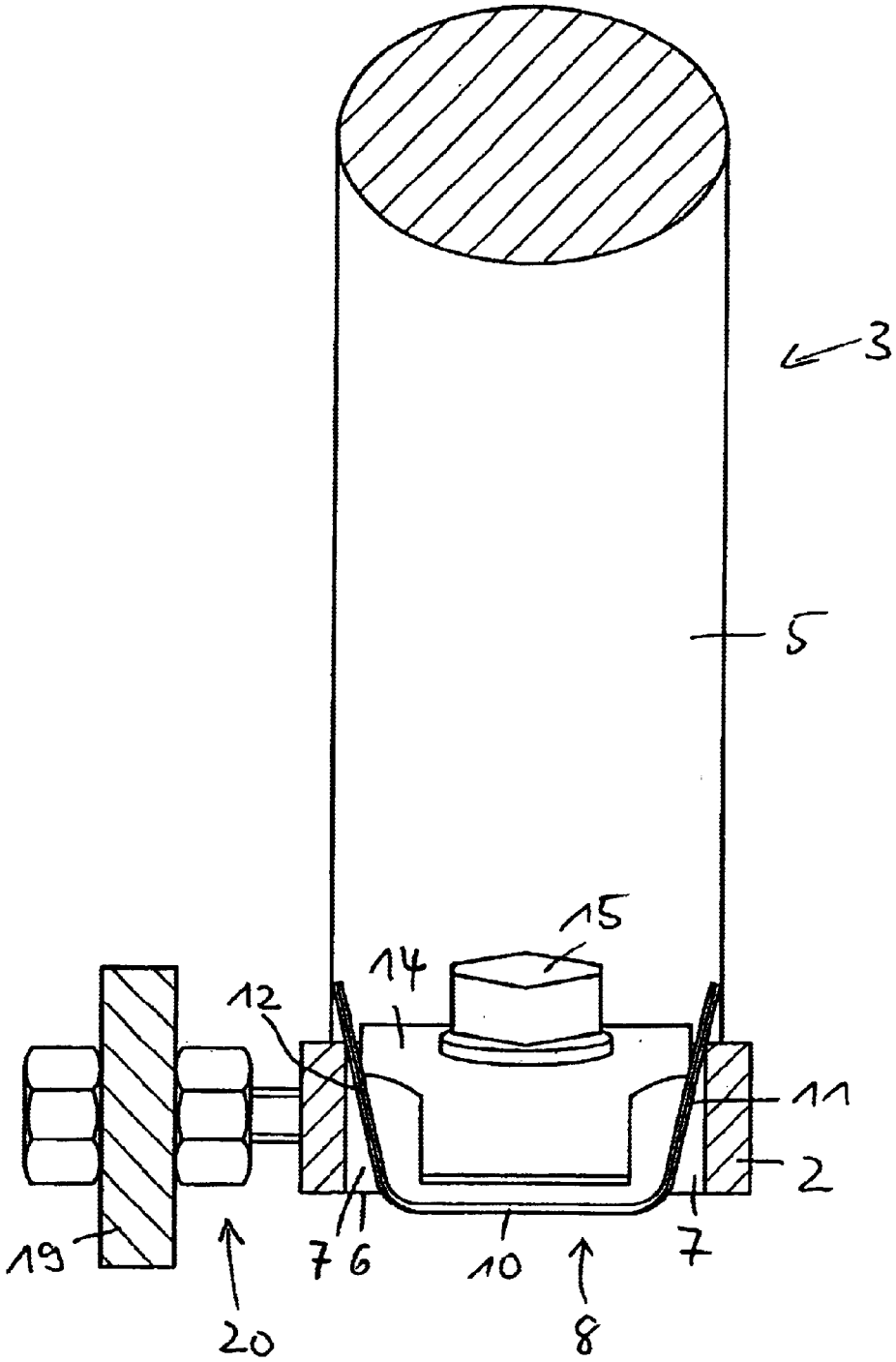
FIG. 2 is a section through the belt skiver corresponding to line A—A of FIG. 1.

As noted above, blade 8 is generally trough-shaped, having a substantially uniform wall thickness, such that cutting edge 9 has a U-shaped front elevational configuration. Blade 8 may be formed from a thin sheet of spring steel or the like. The illustrated blade 8 has curved corners disposed between central area 10 and side areas 11 and 12 which, as shown in FIG. 2, each have a predetermined radius which extends along the length of blade 8.

The illustrated blade 8 is positioned at an acute angle to the bearing surface 6 of the base 2. For this purpose, on its side facing the handle 3, the base 2 is provided with a receiving surface 13 for the blade 8, which surface is inclined at an angle of around 10 degrees to the bearing surface 6 in the preferred embodiment. The blade 8 is locked in place by means of a clamping plate 14 which acts upon the blade 8 in its central region and presses it against the base 2. The clamping plate 14 is tensioned against the base 2 by means of a screw or bolt 15 which traverses the clamping plate 14 and is threaded into a tap 16 in the base 2. The blade 8 thus allows itself to be locked in different positions via the clamping plate 14, with the result that, in the region of the central cutting edge section 10, the cutting edge 9 is distanced from the bearing surface 6 of the base 2 to a greater or lesser extent, in correspondence with the requirements.

In the area of the cutting edge 9, the blade 8 is constructed such that it widens in conical fashion, beginning at the cutting edge 9. In the preferred embodiment, the angle between the cutting flanks 17 and 18 adjacent to the cutting edge 9 corresponds to 20 degrees. The cutting flank 18, which normally faces away from the base 2, is oriented in parallel to the bearing surface 6 of the base 2.

A guide bar 19, arranged parallel to the base 2, is connected to the right side of the belt skiver 1 relative to its direction of motion X. The connection is effected by means of adjustment screws 20 (FIG. 2) which enable parallel adjustment of the guide bar 19 relative to the base, hence toward or away from it. The guide bar 19 extends below the level of the bearing surface 6 of the base 2 and serves to provide lateral contact of the guide bar 19 against the adjacent edge 23 of the conveyor belt to be cut during motion of the belt skiver 1.

Figure 3:
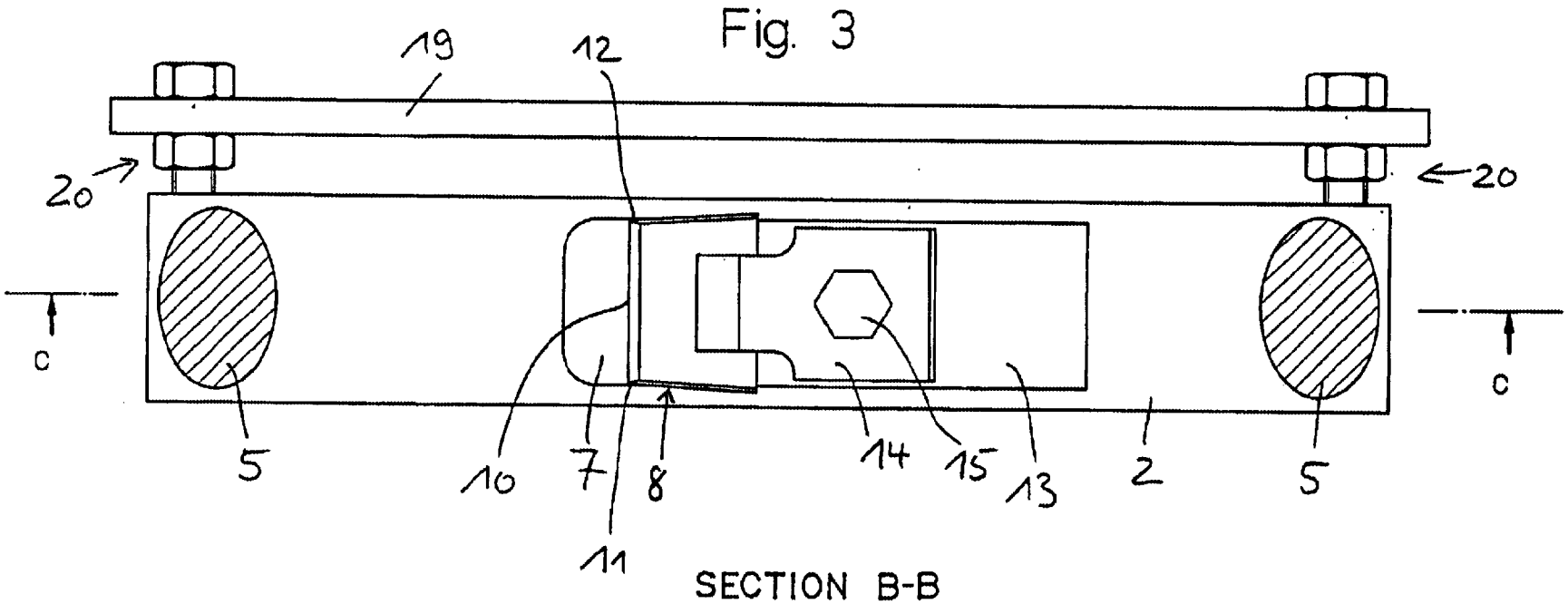
FIG. 3 is a section through the belt skiver corresponding to line B—B of FIG. 1.
Figure 4:
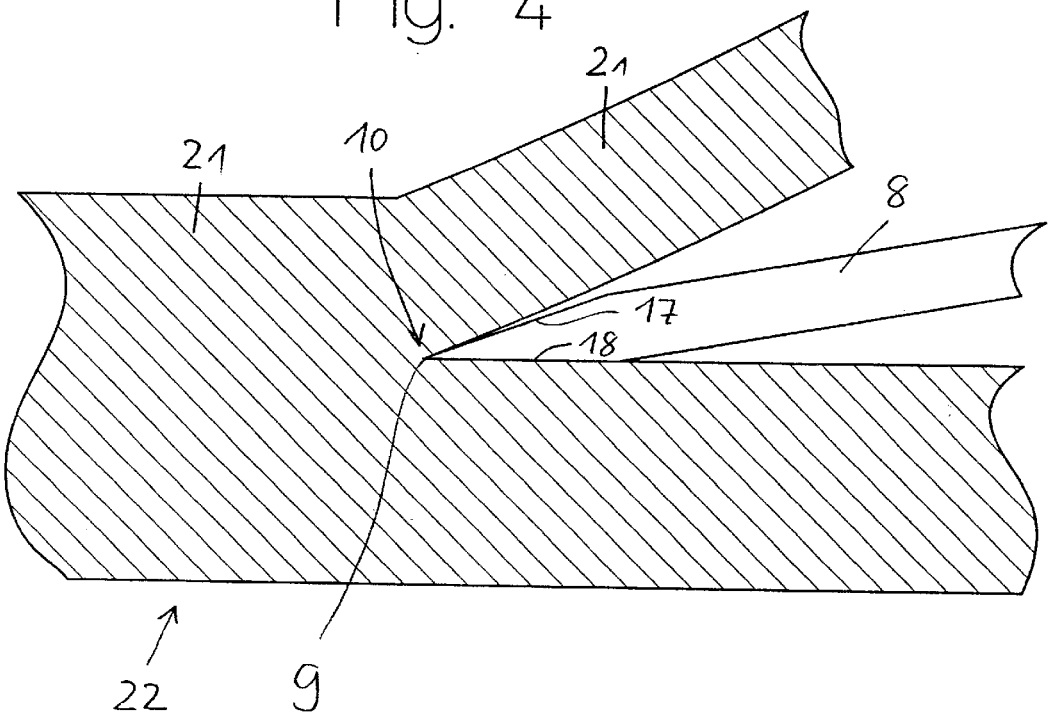
FIG. 4 is a detailed view of the cutting process in the area of the preceding section of the blade that penetrates into the top layer of the conveyor belt.
Figure 6:
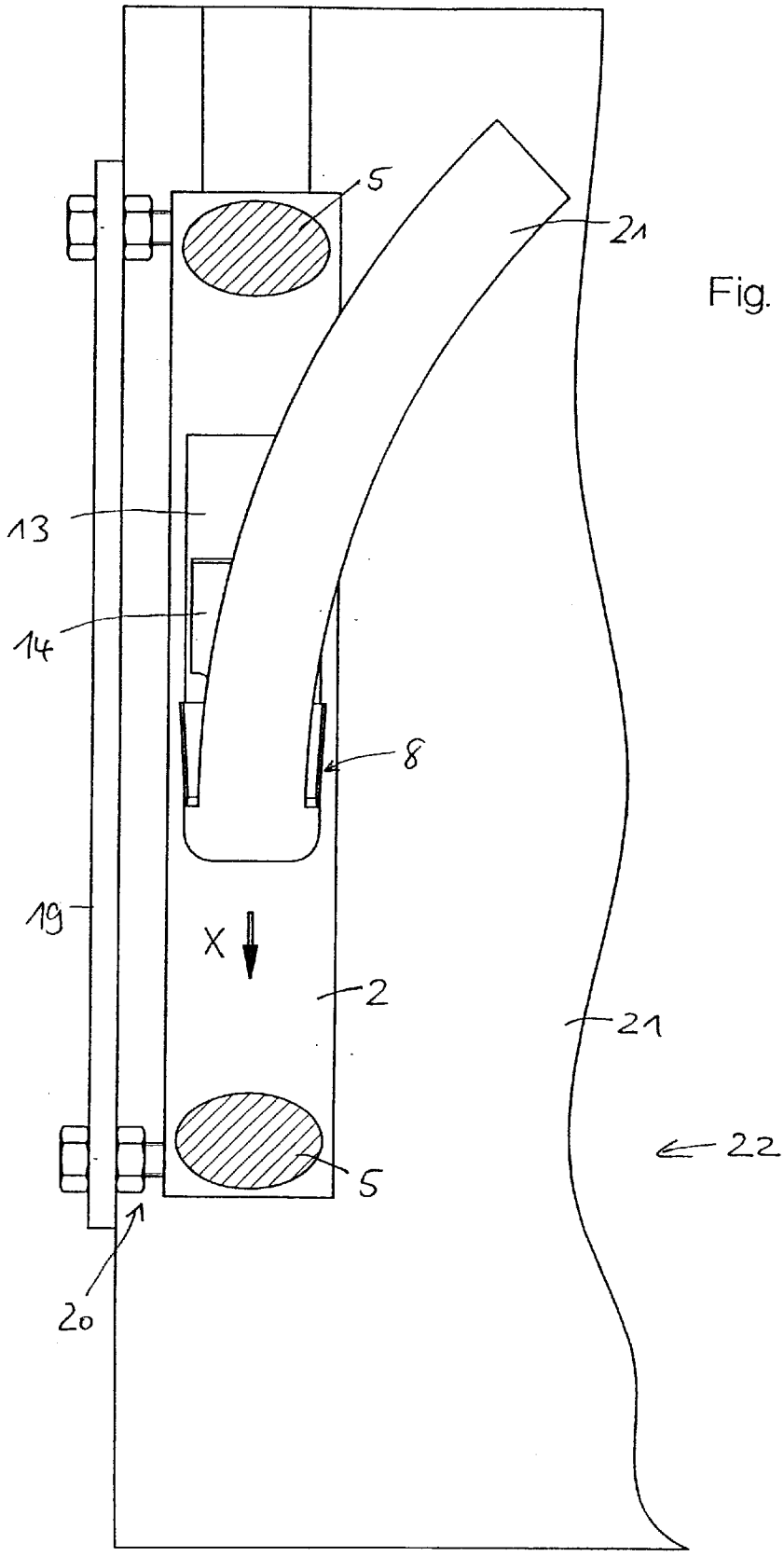
FIG. 6 illustrates the cutting process, clarified on the basis of a sectional representation as per FIG. 3.

FIGS. 1 to 3 clarify the fundamental construction of the belt skiver according to the present invention. The relationships upon removal of the top layer 21 (FIG. 4) or a portion of the top layer of a conveyor belt 22 are illustrated in FIGS. 4 to 6. To effect compressive movement of the belt skiver 1 relative to the direction of motion X, the belt skiver 1 is grasped in the area of the trailing leg 5 of the handle 3, and the area of the bearing surface 6 of the base 2 which precedes the blade 8 is placed upon the top layer 21 of the conveyor belt 22. By exerting a compressive force on the belt skiver 1, the blade 8 is moved into the top layer 21 and cuts it or a portion of it off.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A manual skiver for conveyor belts, comprising:

a base having a generally planar bearing surface adapted for abutting engagement with an associated belt face; said base having a blade receiving opening extending through said bearing surface to an upper portion of said base;

a handle connected with said base, and configured to facilitate manually shifting said skiver across the associated belt face;

a clamping plate connected with the upper portion of said base, and extending to a location adjacent to said blade receiving opening; and a thin cutting blade mounted in said base at a predetermined angle, and including a cutting edge having a generally U-shaped front elevational configuration defining a generally flat central area disposed substantially parallel with said bearing surface and perpendicular to the direction of motion of said skiver across the associated belt face, and upstanding side areas disposed at opposite sides of said central area and oriented a predetermined angle thereto; said U-shaped cutting edge extending through said blade receiving opening in said base, and being disposed a predetermined distance below said bearing surface; said clamping plate pressing a central portion of said blade against the upper portion of said base to retain said blade at said predetermined angle to cut a groove in the associated belt face having a uniform depth.

2. A manual skiver as set forth in claim 1, wherein:

said cutting edge includes curved corners disposed between said central area and said side areas.

3. A manual skiver as set forth in claim 2, wherein:

said side areas of said cutting edge are generally flat.

4. A manual skiver as set forth in claim 3, wherein:

said cutting blade has a predetermined length; and said curved corners of said cutting edge have a predetermined radius extending along the length of said cutting blade.

5. A manual skiver as set forth in claim 4, wherein:

said U-shaped front elevational configuration of said cutting edge is symmetrical.

6. A manual skiver as set forth in claim 5, wherein:

said side areas of said cutting edge are disposed relative to said central area at an angle in the range of 90–120 degrees.

7. A manual skiver as set forth in claim 6, wherein:

said predetermined angle of said cutting blade is in the range of 5–15 degrees.

8. A manual skiver as set forth in claim 7, wherein:

said handle is configured to apply a compressive force between said bearing surface and the associated belt face at a predetermined draw angle; and said predetermined angle of said cutting blade is generally commensurate with said draw angle.

9. A manual skiver as set forth in claim 8, wherein:

said cutting blade has a generally conical shape which tapers outwardly away from said cutting edge.

10. A manual skiver as set forth in claim 9, wherein:

said cutting edge is defined by upper and lower cutting flanks which are mutually oriented at a predetermined angle in the range of 15–25 degrees.

11. A manual skiver as set forth in claim 10, wherein:

said lower cutting flank is disposed generally parallel to said bearing surface.

12. A manual skiver as set forth in claim 11, including:

a guide connected with said base and disposed in a generally parallel, laterally spaced apart relationship to abut an end edge of the associated belt face.

13. A manual skiver as set forth in claim 12, wherein:

said guide is adjustable relative to said base.

14. A manual skiver as set forth in claim 13, wherein:

said base is bar-shaped.

15. A manual skiver as set forth in claim 1, wherein:

said side areas of said cutting edge are generally flat.

16. A manual skiver as set forth in claim 1, wherein:

said cutting blade has a predetermined length; and said cutting edge includes radiused corners disposed between said central area and said side areas extending along the length of said cutting blade.

17. A manual skiver as set forth in claim 1, wherein:

said U-shaped front elevational configuration of said cutting edge is symmetrical.

18. A manual skiver as set forth in claim 1, wherein:

said side areas of said cutting edge are disposed relative to said central area at an angle in the range of 90–120 degrees.

19. A manual skiver as set forth in claim 1, wherein:

said predetermined angle of said cutting blade is in the range of 5–15 degrees.

20. A manual skiver as set forth in claim 1, wherein:

said handle is configured to apply a compressive force between said bearing surface and the associated belt face at a predetermined draw angle; and said predetermined angle of said cutting blade is generally commensurate with said draw angle.

21. A manual skiver as set forth in claim 1, wherein:

said cutting blade has a generally conical shape which tapers outwardly away from said cutting edge.

22. A manual skiver as set forth in claim 1, wherein:

said cutting edge is defined by upper and lower cutting flanks which are mutually oriented at a predetermined angle in the range of 15–25 degrees.

23. A manual skiver as set forth in claim 22, wherein:

said lower cutting flank is disposed generally parallel to said bearing surface.

24. A manual skiver as set forth in claim 1, including:

a guide connected with said base and disposed in a generally parallel, laterally spaced apart relationship to abut an end edge of the associated belt face.

25. A manual skiver as set forth in claim 24, wherein:

said guide is adjustable relative to said base.

26. A manual skiver as set forth in claim 1, wherein:

said base is bar-shaped.

* * * * *